United States Patent [19]

Izumisawa

[11] Patent Number: 4,575,973

[45] Date of Patent: Mar. 18, 1986

[54] GRINDING MACHINE

[76] Inventor: Nobuyuki Izumisawa, 2-19-27, Azusawa, Itabashi-ku, Tokyo, Japan

[21] Appl. No.: 620,097

[22] Filed: Jun. 13, 1984

[30] Foreign Application Priority Data

Jun. 22, 1983 [JP] Japan ..... 58-110990

[51] Int. Cl.[4] ..... B24B 23/04; F01L 31/04; B23D 67/00

[52] U.S. Cl. ..... 51/170 TL; 91/351; 91/352; 92/138; 29/76 A

[58] Field of Search ..... 51/170 TL, 170 R, 175; 91/350, 352, 329, 341 R; 92/136, 138; 29/76 A

[56] References Cited

U.S. PATENT DOCUMENTS

| | | | |
|---|---|---|---|
| 2,224,140 | 12/1940 | Champayne | 91/352 |
| 2,620,775 | 12/1952 | Champayne | 92/138 |
| 3,214,823 | 11/1965 | Hendrickson | 51/170 TL |
| 3,474,512 | 10/1969 | Hansen | 51/170 TL |
| 3,563,134 | 2/1971 | Rodstein | 91/352 |
| 3,835,592 | 9/1974 | Sumida | 51/170 TL |

*Primary Examiner*—Roscoe V. Parker

*Attorney, Agent, or Firm*—Oblon, Fisher, Spivak, McClelland & Maier

[57] ABSTRACT

Compressed air fed into a directional control sleeve is alternatingly delivered to two cylinders via a directional control valve. Pistons within the respective cylinders are each provided with a rack gear moved by feeding compressed air into the cylinders. A grindstone attached to a second set of rack gears is reciprocated through pinion gears by movement of the first-mentioned rack gears. As the grindstone reciprocates, a valve operating arm pivotally supported by a pin is caused to rotate back and forth to switch the directional control valve, thereby switching the cylinder that receives the compressed air. The grinding machine is thus capable of performing grinding in continuous fashion.

1 Claim, 7 Drawing Figures

GRINDING MACHINE

BACKGROUND OF THE INVENTION

1. Field of the Invention:

This invention relates to a grinding machine of the type that reciprocates an abrasive plate by utilizing compressed air.

2. Description of the Prior Art:

A grinding machine of the type that reciprocates an abrasive plate through use of compressed air is generally well-known in the art. Specifically, the grinding machine has a cylinder into which compressed air is supplied through use of a directional control valve to reciprocate a piston housed by the cylinder. Grinding is performed by a grindstone secured directly or indirectly to the piston and reciprocated thereby. There is need for development of a grinding machine which is structurally simple and capable of providing smooth operation.

SUMMARY OF THE INVENTION

Accordingly, an object of the present invention is to provide a grinding machine which is structurally simple, reliable in operation and low in cost.

Another object of the present invention is to provide a grinding machine wherein a directional control valve provided slidably within a directional control sleeve is reciprocated by compressed air fed into the sleeve.

Still another object of the present invention is to provide a grinding machine wherein grinding is performed by a grindstone provided on an operating plate which is coupled by racks and pinions to pistons provided in respective ones of a pair of cylinders.

A further object of the present invention is to provide a grinding machine wherein a directional control valve is changed over by an operating arm having one end connected to an operating plate and the other end connected to the directional control valve.

Other objects, features and advantages of this invention will be readily appreciated as the invention becomes better understood with reference to the following detailed description when considered in connection with the accompanying drawings.

DESCRIPTION OF THE PREFERRED EMBODIMENT

Figure 1:
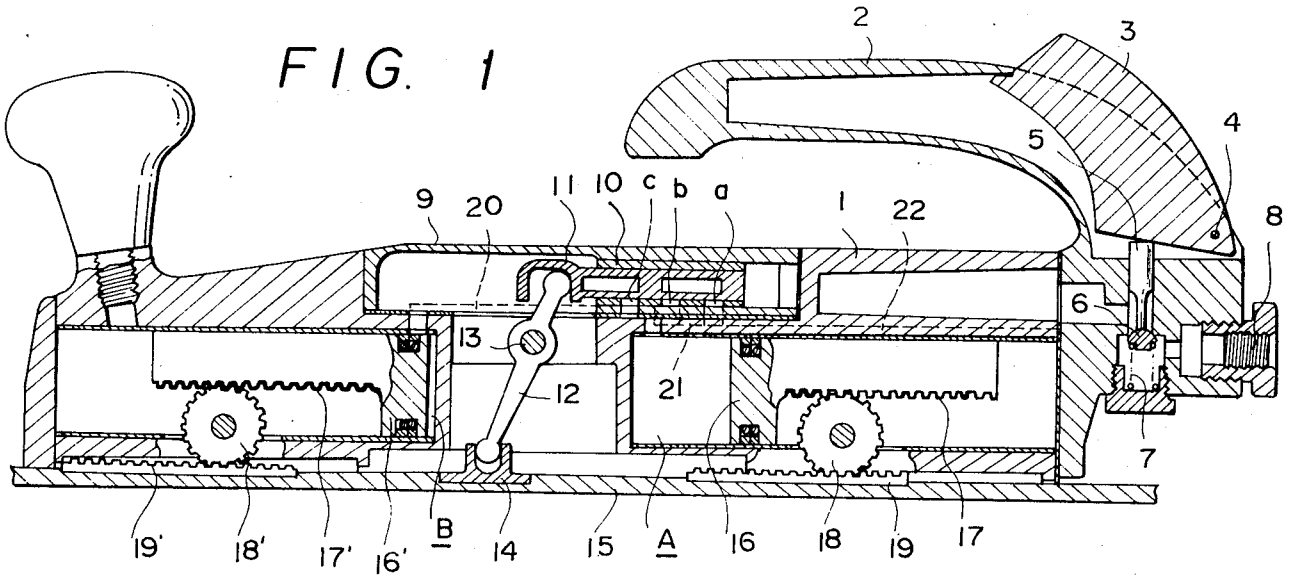
FIG. 1 is a longitudinal sectional view illustrating an embodiment of a grinding machine according to the present invention.

With reference first to FIG. 1, a grinding machine embodying the present invention has a main body 1 consisting of a material such as a synthetic resin or aluminum alloy. The grinding machine includes a handle 2 having an operating lever 3 pivotally supported on one end of the body 1 by a pin 4. A valve operating rod 5 has an upper end abutting against the operating lever 3 and is adapted to open a valve 6 when the operating lever 3 is depressed. The valve 6 is biased in the closing direction (upward in FIG. 2) by a spring 7 at all times. An air supply port 8 communicates with a hose (not shown) for supplying compressed air.

A directional control valve case 9 is provided at the upper, central portion of the body 1 and has a directional control sleeve 10 secured therein. The directional control sleeve 10 is adapted to permit reciprocating motion of a direction control valve 11. A valve operating arm 12, which is pivotally supported on the body by means of a pin 13, has one end thereof engaged with the directional control valve 11 and the other end engaged with a guide 14 attached to an operating plate 15.

Provided within the body 1 are a cylinder A and a cylinder B slidably accommodating pistons 16, 16', respectively. The pistons 16, 16' have back faces provided with rack gears 17, 17' meshing with pinions 18, 18', respectively. Fixedly secured to the operating plate 15 are rack gears 19, 19' meshing with the pinions 18, 18'. Attached to the lower side of the operating plate 15 is a grinding body, which is not shown.

The directional control sleeve 10 is provided with three holes a, b, c. Numeral 20 denotes a passage provided in the body 1 and communicating with the cylinder B. Numeral 21 denotes a passage provided in the body 1 and communicating with the cylinder A. Provided in the body 1 is a passage 22 communicating with the air supply port 8.

Reference will now be had to FIGS. 2(A) through 2(F) to describe the operation of the grinding machine shown in FIG. 1. To facilitate the description, the holes a, b, c in the directional control sleeve, the passages 20, 21 communicating with the cylinders A, B, and the passage 22 communicating with the air supply port 8, are shown to have positional relationships different from those of FIG. 1. The reason is that the various passages which do not actually lie in the same plane are shown in FIG. 2 as being coplanar to simplify the description.

Figure 2:
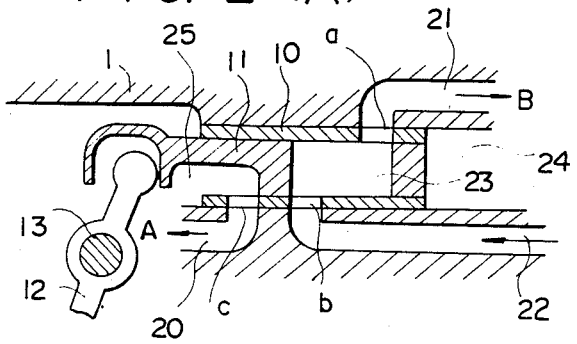
FIGS. 2(A) through 2(F) are longitudinal sectional views of the grinding machine and are useful in describing the operation of a directional control valve.
Figure 2:
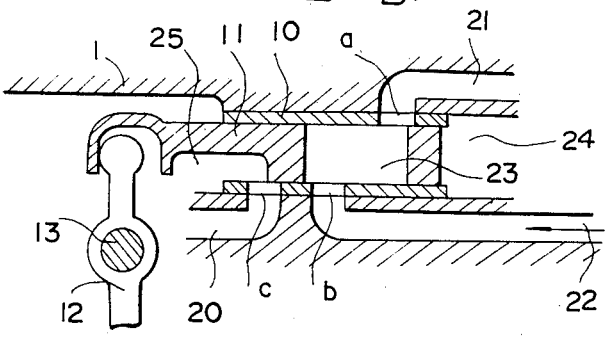
Figure 2:
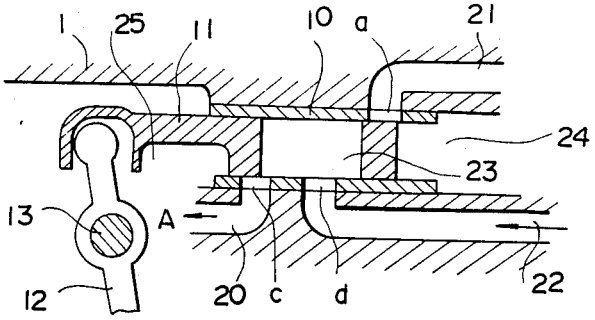
Figure 2:
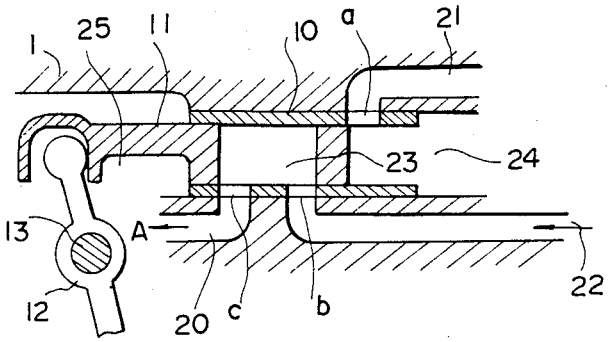
Figure 2:
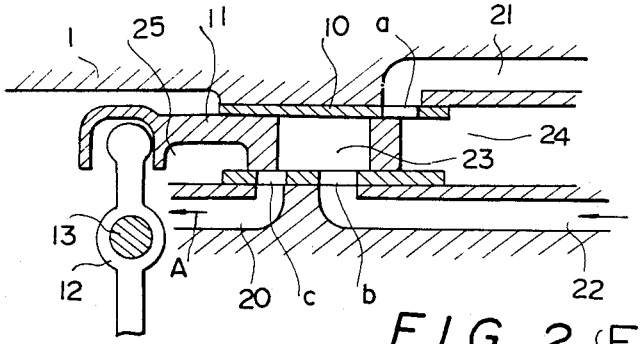
Figure 2:
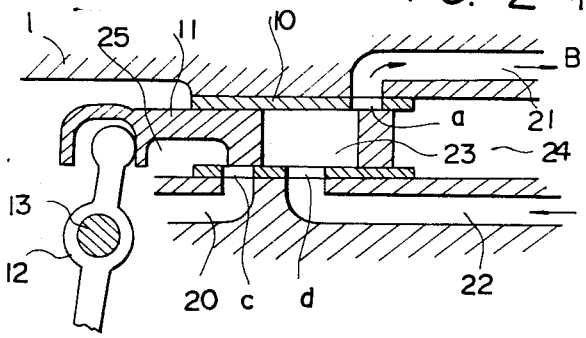

In FIG. 2, the passage 20 communicates with the cylinder A, passage 21 with cylinder B, and passage 22 with the air supply port. In addition, passages 24, 25 are provided for communicating with the atmosphere. Numeral 23 denotes a passage within the directional control valve 11.

(1) In operation, compressed air is introduced from the air supply port 8 starting from the condition shown in FIG. 1. As shown in FIG. 2(A), the compressed air is fed into the cylinder B via the valve 6, passage 22, hole b, passage 23 in the directional control valve, and passage 21, whereby the piston 16' is moved leftward in FIG. 1, causing the pinion 18' to move the operating plate 15 to the right. At this time the piston 16 is also moved leftward in similar fashion by the pinion 18, and the valve operating arm 12 is turned simultaneously about the pin 13 via the guide 14. The directional control valve 11 is thus slid to the left, during which time the air confined within the cylinder A is discharged into the atmosphere through the passage 20.

(2) FIG. 2(B) shows the piston 16' moved further to the left to an attitude where it is perfectly centered. When the piston 16' is moved leftward still further to assume the attitudes shown in FIGS. 2(C) and 2(D), the directional control valve 11 is slid by the valve operating arm 12 to bring the hole c and the passage 20 into communication, whereby compressed air is supplied from passage 20 to the cylinder A. This causes the piston 16 within the cylinder A to begin operating rightwardly in FIG. 1. Consequently, the air confined within the cylinder B now is expelled into the atmosphere 24 via the passage 21.

(3) When the piston 16 is moved further to the right, as shown in FIG. 2(E), to assume the attitude depicted in FIG. 2(F), the passage 21 to cylinder B and the hole a are brought into communication, whereby air begins to be supplied to the cylinder B to restore the grinding machine to the attitude illustrated in FIG. 2(A). At the same time, hole c and passage 25 are communicated so that the air in cylinder A is discharged.

Thus, according to the present invention, it is arranged so that the valve operating arm 12 is pivotally supported on the body 1 with one end of the arm being made to follow the motion of the operating plate 15, and so that the directional control valve 11 engaging with the other end of the arm 12 slides to open and close the air supply and discharge holes.

Since the directional control valve 11 is thus operated by the operating arm 12, the grinding machine operates in a reliable manner and is simple in structure. As a result, the machine is capable of being manufactured at lower cost and is virtually trouble-free.

As many apparently widely different embodiments of the present invention can be made without departing from the spirit and scope thereof, it is to be understood that the invention is not limited to the specific embodiments thereof except as defined in the appended claims.

What we claim is:

1. A grinding machine comprising:

a main body;

a directional control valve case provided on said main body;

a directional control sleeve fixedly secured within said directional control valve case;

a valve for feeding compressed air into said directional control sleeve;

first and second cylinders provided within said main body at front and rear ends thereof;

a directional control valve slidable back and forth within said directional control sleeve for communicating said first and second cylinders;

first and second pistons for reciprocating within said first and second cylinders, respectively;

first and second rack gears provided on said first and second pistons, respectively;

first and second pinions meshing with said first and second rack gears, respectively;

an operating plate having a grinding body attached to a lower surface thereof;

third and fourth rack gears provided on said operating plate and meshing with said first and second pinions 18, 18', respectively, for reciprocating said operating plate;

a guide provided on said operating plate; and a valve operating arm 12 having one end engaging said guide and another end engaging said directional control valve, said valve operating arm being pivotally supported on said main body by a pin for switching said directional control valve in response to reciprocation of the said operating plate.

* * * * *